United States Patent [19]

Manfredini

[11] Patent Number: 4,590,952

[45] Date of Patent: May 27, 1986

[54] AUTOMATIC CONTROL DEVICE FOR ADJUSTING THE SUCTION EXERTED BY SUCTION FLUTES IN CIGARETTE TRANSFER DRUMS

[75] Inventor: Alfonso Manfredini, S. Lazzaro di Savena, Italy

[73] Assignee: Sasib S.p.A., Bologna, Italy

[21] Appl. No.: 292,398

[22] Filed: Aug. 13, 1981

[30] Foreign Application Priority Data

Aug. 29, 1980 [IT] Italy ..... 12636 A/80

[51] Int. Cl.[4] ..... A24C 5/35; A24C 5/47; A24C 5/00

[52] U.S. Cl. ..... 131/94; 131/282

[58] Field of Search ..... 131/280, 282, 283, 94

[56] References Cited

U.S. PATENT DOCUMENTS 4,030,511 6/1977 Wahle ..... 131/94

4,197,864 4/1980 Molins ..... 131/94

*Primary Examiner*—V. Millin

*Attorney, Agent, or Firm*—Spencer & Frank

[57] ABSTRACT

An automatic control device for adjusting the suction force exerted by the flutes of a rotary transfer drum for rod-like articles such as cigarettes includes an adjustable control device operatively interposed between the suction ports of the flutes and a source of vacuum. The adjustable control device is actuated by a pilot unit in response to a tachymetric signal which is representative of the speed of production of the cigarette-making machine.

9 Claims, 4 Drawing Figures

AUTOMATIC CONTROL DEVICE FOR ADJUSTING THE SUCTION EXERTED BY SUCTION FLUTES IN CIGARETTE TRANSFER DRUMS

BACKGROUND AND SUMMARY OF THE INVENTION

The present invention relates to machines for the handling of rod-like articles such as for example cigarettes and filter plugs. More particularly, the invention relates to cigarette-making machines, in which a continuous cigarette rod is cut into single segments presenting the length of a cigarette or a multiple of this length.

After the segments (cigarettes) after they been cut from the cigarette rod, they are accomodated singularly inside the successive flutes of a rotary transfer drum, in order to be subsequently sent to further processing stations.

In the rotary transfer drums, the flutes present at their bottom a row of suction ports or orifices, which are put in communication with a source of pneumatic vacuum. Thus, the desired suction effect is obtained, for holding the cigarettes firmly in the flutes, and for gently braking their inlet speed into the flutes (the cigarettes are fed at a relatively high speed, lengthwise, into the suction flutes of the transfer drum), so that the cigarettes abut gently, with no shocks or bouncing, against an abutment member provided at the end of the flute opposite to the inlet end.

Now, it appears evident that the inlet speed of the cigarettes running lengthwise into the flutes increases proportionally with the speed of production, or working speed, of the cigarette-making machine.

Consequently, in order to obtain and maintain an optimum braking effect due to the suction, at each value of the inlet speed of the cigarettes into the flutes (which speed is proportional to the speed of production of the cigarette-making machine), there should correspond a determined value of the vacuum which generates the suction effect through the ports at the bottom of the said flutes.

Presently, in medium and low-speed cigarette-making machines, it is sufficient to establish a mean value of the vacuum in order to guarantee correct braking of the cigarettes, both upon starting of the cigarette-making machine and upon maximum speed of production.

The above mentioned criterion of establishing a mean value of vacuum is not permissible in the high-speed cigarette-making machines. In fact, by this criterion, the braking effect is excessive when the machine is started, so that the cigarettes are braked in the flutes before reaching the abutment member at the end of the flute. On the other hand, the mean value of vacuum does not guarantee a sufficient braking effect at the highest production speeds, so that the cigarettes abut against the abutment members still at a high speed so that they may be damaged or bounce back, thus spoiling the correct formation of the row of consecutive cigarettes on the transfer drum.

In order to avoid the above mentioned inconveniences, the present invention proposes an automatic control device for suction braking the cigarettes as they enter at high speed the flutes of a transfer drum, which is characterized by the fact that it comprises an adjustable control device, usually in the form of a throttle valve, operatively inserted between the suction ports of the flutes and the vacuum source, said adjustable control device being capable of automatically adjusting the suction exerted by the flutes in a manner substantially proportional to the speed of production of the cigarette-making machine.

According to a first embodiment of the invention, the adjustable control device operates to control the rate at which vacuum is applied to the suction ports of the flutes.

According to another embodiment of the invention, the adjustable control device operates to selectively control, so as to open or close the channel vacuum, the number of suction ports connected to the source of vacuum.

The above and other features of the invention, and the advantages deriving therefrom, will appear evident from the following detailed description of some preferred embodiments, made by way of non-limiting examples.

DESCRIPTION OF THE PREFERRED EMBODIMENTS

Figure 1:
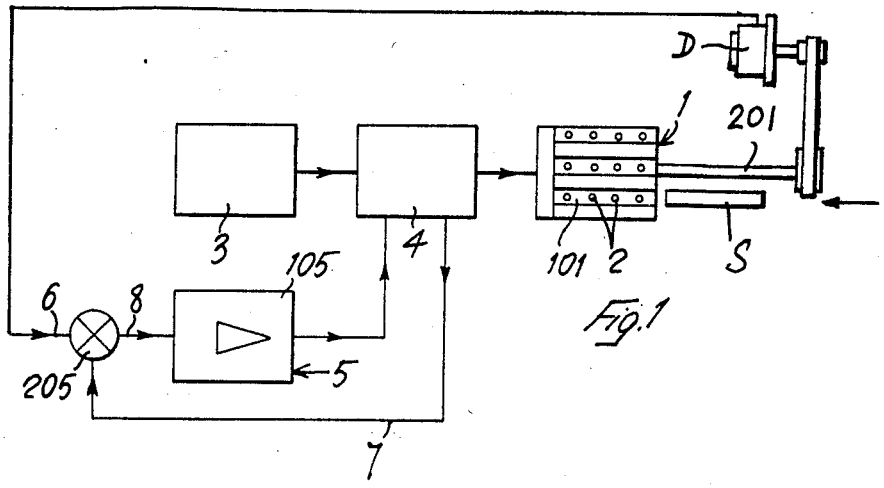
FIGS. 1 to 4 are block diagrams, showing four different embodiments of the automatic control device according to the present invention.

With reference to the drawings in general, a control device according to the present invention, for automatically controlling, in relation to the working speed of a continuous cigarette-making machine, the pneumatic vacuum at the suction ports 2 of the flutes 101 of a fluted rotary transfer drum 1, connected with a source of vacuum 3, comprises an adjustable control device 4, interposed between the vacuum source 3 and the drum 1 in order to adjust the vacuum applied to drum 1 in relation to the working speed of the cigarette-making machine.

The signal for adjusting the control device 4 is supplied by a pilot unit 5, in response to the input on a line 6 of a tachymetric signal which is representative of the actual working speed of the machine for making the cigarettes, and consequently of the rotary suction drum 1 operatively mounted in the cigarette-making machine.

In the embodiment shown in FIG. 1, the control device 4, for adjusting the pneumatic flow between the vacuum source 3 and the suction drum 1, consists of a servo-controlled choke valve, for instance of the throttle shutter type, the degree of opening of which is proportioned to the working speed of the cigarette-making machine.

The proportioning of the degree of opening of the throttle is obtained by providing an electric reversible motor, controlled by a pilot unit 5 comprising an operational amplifier 105 which actuates the motor for positioning the throttle in response to the signal at the output of a comparator 205. Comparator 205 receives as an input on line 6 the tachymetric signal supplied by a speedometer dynamo D which is driven, via a suitable belt and pulley transmission, by the shaft 201 of the rotary drum 1 and which is therefore responsive to the actual working speed of the cigarette-making machine. Comparator 205 also receives, as an input 7, a return signal from valve 4, this latter signal being representative of the position of the throttle of the valve.

According to this embodiment, the tachymetric signal, which is indicative of the production speed of the cigarette-making machine, is compared with a signal which is representative of the angular position of the valve throttle and consequently with the actual vacuum applied to the rotary suction drum 1. The so-called error signal resulting from the comparison at the output 8 of comparator 205 acts as an input signal for the amplifier 105 and controls the rotation of the throttle motor so as to modify the position of the throttle in order to maintain the optimum vacuum at suction drum 1 for all production speeds of the cigarette-making machine.

The above described embodiment can maintain the appropriate values of vacuum in drum 1 provided that the fluctuations of vacuum at the source 3 are null or negligible.

Figure 2:
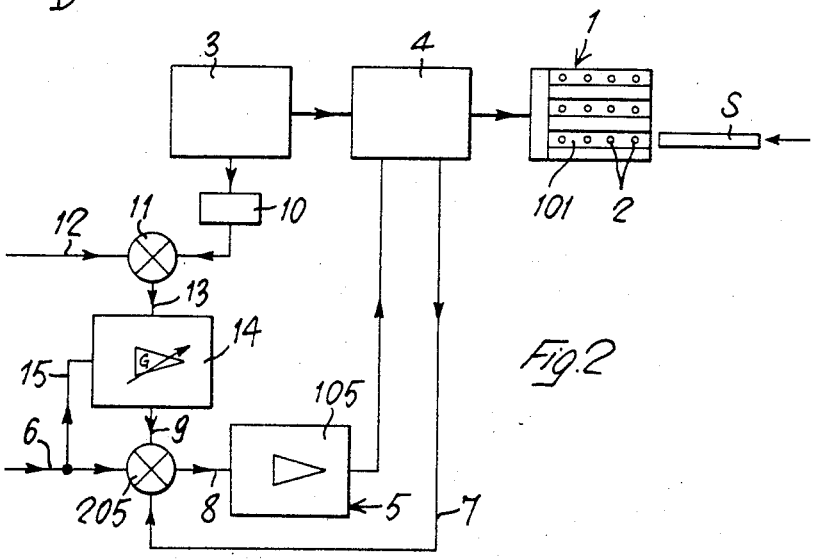

If the fluctuations cannot be neglected in the adjustment of the optimum vacuum in drum 1, the control device according to the invention is modified as shown in FIG. 2, by providing a third input 9 to the comparator 205 in order to introduce, in the comparison from which the error signal is generated at the output 8 of the comparator itself, a correction factor which takes into account the dynamic fluctuations of the vacuum at source 3.

This correction factor is obtained starting at a piezoelectric transducer 10 which supplies, in a continuous manner, a signal which is representative from the actual value of the vacuum at the vacuum source 3.

In a second comparator 11 the signal from transducer 10 is compared wth a constant reference signal, suitably applied to input 12, which is representative of the predetermined value (nominal value) of vacuum at vacuum source 3.

The result of this comparison, that is, the relative fluctuation of the actual vacuum at vacuum source 3 with respect to the nominal vacuum, is present at the output 13 of the comparator 11.

This signal at the output 13 is conveyed to input 9 of the comparator 205 via a variable gain amplifier 14, the gain of which is made dependent on the tachymetric signal which is present on line 6 by means of an input connection 15.

By the thus established dependency, the signal representing vacuum fluctuation, provided by comparator 11 on output 13, is subjected, through amplifier 14, to different corrective interventions in relation to the working speed of the cigarette-making machine, represented by the tachymetric signal on line 6.

In this manner, the vacuum fluctuation at the source 3 becomes a function (dynamic) of the production speed, and as such it is applied to the third input 9 of the comparator 205, as a further factor for correction of the error signal for the amplifier 5 which eventually controls the angular positioning of the throttle of the throttle valve 4.

In the embodiment of FIG. 1, the error signal is processed in comparator 205 as the difference between the tachymetric signal on line 6 and a feedback or return signal on line 7. According to the embodiment of FIG. 1, the feedback signal is directly provided by the choke valve 4, as a position signal of the valve throttle.

Figure 3:
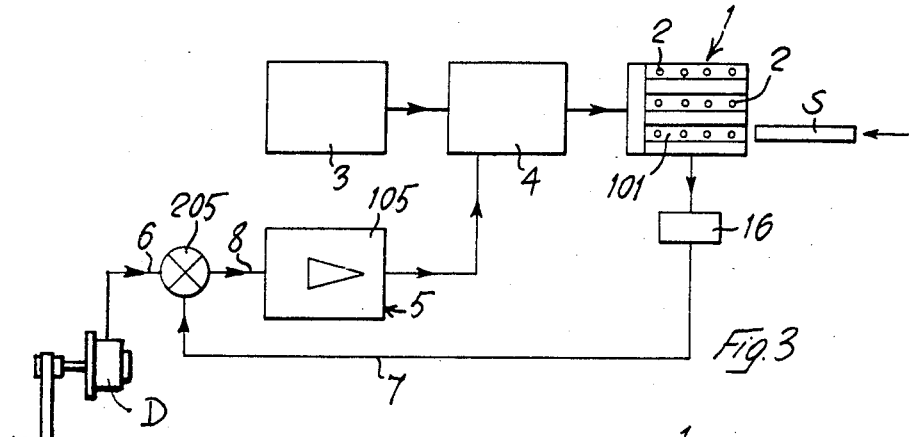

According to the embodiment shown in FIG. 3, the feedback signal for the optimum positioning of the throttle of the choke valve 4 is directly produced by the actual vacuum which generates the correct suction through the ports 2 of the fluted drum 1.

For this purpose, as it appears from FIG. 3, a piezoelectric transducer 16 is operatively associated with drum 1 and generates an electric signal which is representative of the actual vacuum existing in the pneumatic chamber of the drum itself. This signal is carried on line 7 to the corresponding input of the comparator 205 for comparison with the tachymetric signal, which arrives through line 6. The tachymetric signal can be generated (as in the embodiment of FIG. 1) by a speedometer dynamo associated with the shaft of the rotary suction drum, or by the speedometer dynamo D associated with any other driving or driven shaft 16 of the cigarette-making machine, the rotational speed of which is representative of the working speed of the machine itself.

The error signal resulting from this comparison is amplified in power by the amplifier 5 and is supplied to the reversible motor which controls the positioning of the throttle of the choke valve 4, in such a manner as to always maintain the required suction in drum 1.

It appears evident that the control device in accordance with the embodiment of FIG. 3 is also capable of maintaining the optimum value of the vacuum in drum 1 independently from the possible fluctuations of the vacuum at the vacuum source 3.

In the embodiments so far described with reference to FIGS. 1 to 3, the braking effect due to the suction at the different speeds of production of the cigarette-making machine is maintained at its optimum by adjusting the value of the vacuum inside the vacuum chamber of the fluted drum 1.

Figure 4:
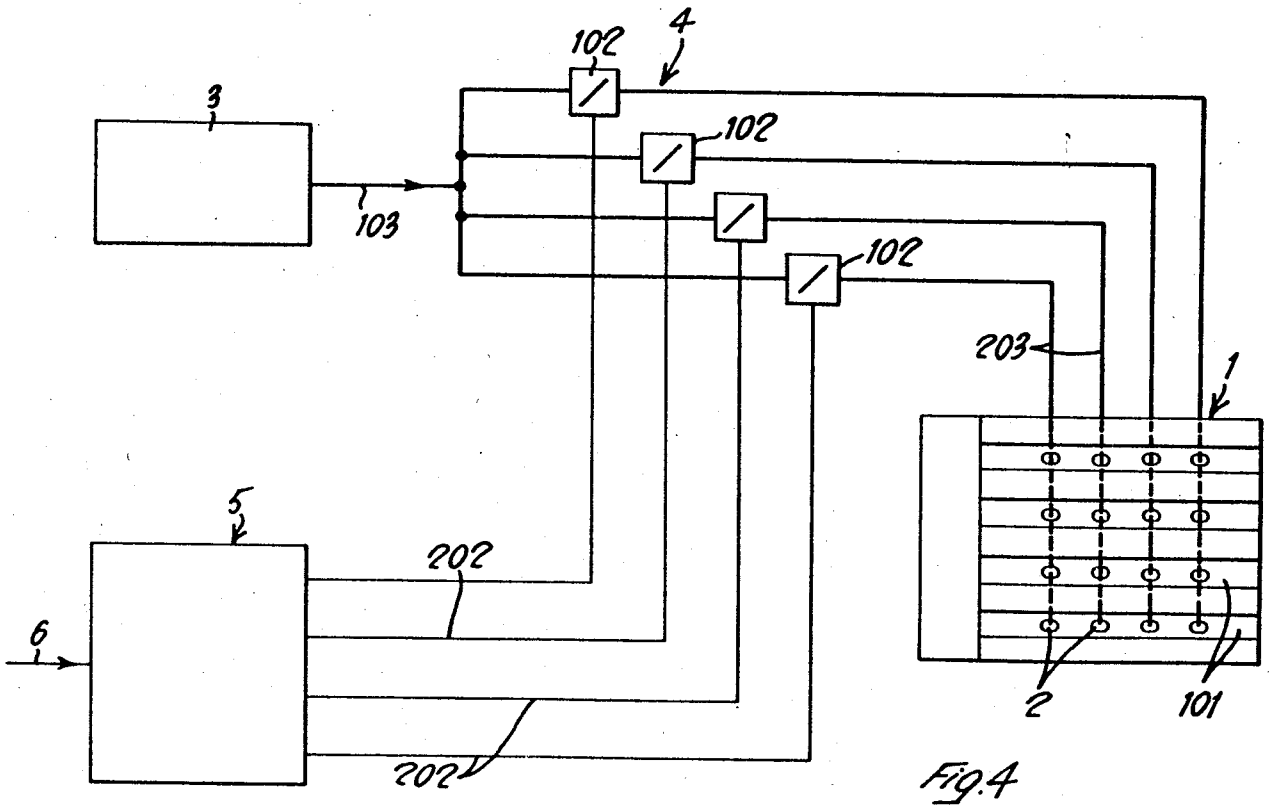

In the embodiment shown in FIG. 4 the braking effect is obtained and maintained by selectively rendering operative one or more of the suction ports 2 of the drum 1, as a function of the speed of production of the cigarette-making machine.

For this purpose, the adjustable control device 4, operatively interposed between the fluted drum 1 and the vacuum source 3, consists of a series of motor driven flow-intercepting means, and particularly of electrovalves 102, mounted so as to communicate on one side with the main duct 103 of the vacuum source 3 and on the other side with a bundle of single branch ducts 203, each of said branch ducts 203 being in communication with a respective suction port 2 forming part of the row of suction ports arranged at the bottom of the flutes 101 of the fluted drum 1.

Through the electric inputs 202, each one of the electrovalves 102 of the series can be individually controlled by the pilot unit 5 which, in the present embodiment, consists of a circuit for the sequential actuation of the lines 202, in response to the tachymetric signal on line 6, which represents the actual working speed of the cigarette-making machine.

When the actual working speed of the cigarette-making machine increases, an increased number of outputs 202 are actuated, so that the number of ports 2 which are rendered operative (i.e. exerting suction) at the bottom of flutes 101 correspondingly increases, with consequent increase of the braking effect on the cigarettes which are being lengthwise introduced into the flutes 101.

Of course, one signal electrovalve 102 can control one or more suction ports 2 of each flute 101.

It is believed that the invention will have been clearly understood from the foregoing detailed description of the preferred embodiments. Changes in the details of construction may be resorted to without departing from the spirit of the invention, and it is accordingly intended that no limitation be implied and that the hereto annexed claims be given the broadest interpretation to which the employed language fairly admits.

What I claim is:

1. An automatic control device for a rotary longitudinally fluted suction drum having flutes with a plurality of suction ports communicating with a vacuum source, rod-like articles from a cigarette-making machine being introduced lengthwise into said flutes and being braked and retained in said flutes due to the suction exerted through said suction ports, comprising: an adjustable control device operatively inserted between said suction ports and said vacuum source; and control means connected to said adjustable control device for automatically adjusting the suction exerted by the flutes substantially proportionally to the speed of production of the cigarette-making machine.

2. A control device according to claim 1, wherein the adjustable control device comprises means for controlling the rate at which vacuum is applied to the suction ports of the flutes.

3. A control device according to claim 2, wherein said means for controlling the rate comprises an adjustable, electrically operated throttle valve connected between the vacuum source and the suction ports, and wherein the control means comprises a speedometer dynamo which emits an electric tachymetric signal corresponding to the actual speed of production of the cigarette making machine, and pilot unit means responsive to at least the tachymetric signal for automatically activating the throttle valve.

4. A control device according to claim 3, wherein said control unit means additionally comprises comparator means for comparing the tachymetric signal and a feedback signal which is representative of the degree of opening of the valve, said comparator means having an output signal to which said pilot unit means is responsive.

5. A control device according to claim 3, wherein said control unit means additionally comprises a piezoelectric transducer operatively connected to the drum and comparator means for comparing the tachymetric signal and a feedback signal supplied by the piezoelectric transducer and representative of the actual vacuum existing in the fluted drum, said comparator means producing an output signal to which said pilot unit means is responsive.

6. A control device according to claim 4, wherein said control unit means additionally comprises vacuum variation means for generating a correction signal for compensating for variations in the actual vacuum at the vacuum source, and wherein said comparator means comprises means for comparing, in addition to the tachymetric signal and to the feedback signal, also the correction signal for compensating for variations in the actual vacuum at the vacuum source.

7. A control device according to claim 6, wherein said vacuum variation means comprises a piezoelectric transducer connected to the vacuum source and supplying a vacuum source signal which is representative of the actual vacuum at the vacuum source, additional comparator means for generating an error signal by comparing said vacuum source signal with a reference signal, and a variable gain amplifier having inputs which receive the error signal and the tachymetric signal and having an output connected to the comparator means.

8. A control device according to claim 1, wherein the adjustable control device comprises means for selectively controlling the number of suction ports of each flute connected to the source of vacuum.

9. A control device according to claim 8, wherein said means for controlling the number comprises an electrovalve connected between each suction port of a flute of the fluted drum and the vacuum source, and wherein said control unit means comprises a speedometer dynamo which emits an electric control signal representative of the speed of production of the cigarette-making machine, and pilot unit means responsive to the electric control signal for selectively controlling the electrovalves.

* * * * *